US009472175B2

(12) United States Patent
Wada et al.

(10) Patent No.: US 9,472,175 B2
(45) Date of Patent: Oct. 18, 2016

(54) DRUM HEAD AND DRUM

(71) Applicant: YAMAHA CORPORATION, Hamamatsu-shi, Shizuoka-ken (JP)

(72) Inventors: Yohei Wada, Hamamatsu (JP); Ryuji Hashimoto, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 15/051,934

(22) Filed: Feb. 24, 2016

(65) Prior Publication Data

US 2016/0275925 A1 Sep. 22, 2016

(30) Foreign Application Priority Data

Mar. 18, 2015 (JP) ..... 2015-055088

(51) Int. Cl.
*G10D 13/02* (2006.01)

(52) U.S. Cl.
CPC ..... *G10D 13/027* (2013.01)

(58) Field of Classification Search
CPC ..... G10D 13/027
See application file for complete search history.

(56) References Cited

U.S. PATENT DOCUMENTS 4,254,685 A * 3/1981 Rose ..... G10D 13/027 84/411 R
4,616,552 A * 10/1986 Jang ..... G10D 13/027 84/414
5,159,139 A 10/1992 Beals et al.
5,637,819 A 6/1997 Rogers
6,518,490 B2 * 2/2003 Good ..... G10D 13/027 84/411 R
6,525,249 B1 * 2/2003 Suenaga ..... G10D 13/024 84/104
6,700,044 B1 3/2004 Bencome, Jr.
6,784,352 B2 * 8/2004 Suenaga ..... G10D 13/024 84/104
2013/0312585 A1 * 11/2013 Yunbin ..... G10D 13/027 84/414
2014/0026733 A1 1/2014 Hashimoto

FOREIGN PATENT DOCUMENTS

CN 102930858 A 2/2013
EP 2690617 A2 1/2014
JP 3835084 B2 10/2006

OTHER PUBLICATIONS

Extended European Search Report issued in counterpart application No. EP16158914.8, mailed Aug. 17, 2016.

* cited by examiner

*Primary Examiner* — Robert W Horn
(74) *Attorney, Agent, or Firm* — Rossi, Kimms & McDowell LLP

(57) ABSTRACT

A drum head includes a skin having an inner skin and an outer skin formed integrally with an outer edge of the inner skin. The inner skin has a plurality of openings arranged in a circumferential direction of the inner skin. An outline of each of the plurality of openings has an inner end portion in a radial direction of the skin in plan view, and the inner end portion protrudes and tapers inward in the radial direction.

12 Claims, 13 Drawing Sheets

DRUM HEAD AND DRUM

CROSS REFERENCE TO RELATED APPLICATION

The present application claims priority from Japanese Patent Application No. 2015-055088, which was filed on Mar. 18, 2015, the disclosure of which is herein incorporated by reference in its entirety.

BACKGROUND

1. Technical Field

The following disclosure relates to a drum head and a drum including the drum head.

2. Description of the Related Art

In general, acoustic drums produce a large sound when a drum head is struck. Thus, reduction in sound volume is required in consideration of a place where the drum is played and a balance between the volume of sounds produced by the drum and the volume of sounds produced by other musical instruments to be played with the drum.

There are conventionally known various constructions for reducing the volume of sounds produced by drums. For example, Patent Document 1 (U.S. Pat. No. 5,637,819) discloses a construction in which various kinds of mute components are attached to a striking side of a drum head and a portion of a back side of the drum head from the striking side. When the drum head is struck, these mute components absorb vibration of the drum head to reduce the volume of sound produced by the drum head.

Patent Document 2 (Japanese Patent No. 3835084) discloses a drum head having a multiplicity of small holes formed in the entire drum head. Each opening of the small holes has an extremely small diameter which ranges between one-tenth of several millimeters and several millimeters, for example. Even when the drum head is struck and vibrated in this construction, a reduced amount of vibration of the drum head propagates to air, resulting in reduction in volume of sound produced by the drum head.

SUMMARY

However, in the case of a drum in which the mute components are attached to the drum head as disclosed in Patent Document 1, sustain of sound produced by strike is considerably shorter than in the case of a common drum head provided with no mute components. It is noted that sustain is a length of time during which the sound remains before the sound becomes inaudible. Since the sustain is relatively short, tone color of sound produced by the drum using the mute components is unclear or unnatural (deteriorated) when compared with tone color produced by the common drum head.

In the drum head disclosed in Patent Document 2, sound produced by strike has unnatural tone color in which sustain is considerably shorter than that of the common drum head, and only attack is emphasized. In addition, stress concentration occurs on the drum head due to the multiplicity of small holes, resulting in reduced durability.

Accordingly, an aspect of the disclosure relates to a drum head and a drum including the drum head with sustain brought closer to that of common drum heads to obtain tone color closer to that of the common drum heads, with reduction in volume of sound produced by strike of the drum head.

In one aspect of the disclosure, a drum head includes a skin having an inner skin and an outer skin formed integrally with an outer edge of the inner skin. The inner skin has a plurality of openings arranged in a circumferential direction of the inner skin. An outline of each of the plurality of openings has an inner end portion in a radial direction of the skin in plan view, and the inner end portion protrudes and tapers inward in the radial direction.

In another aspect of the disclosure, a drum includes a body and the drum head. The drum head is mounted in an opening of the body.

In another aspect of the disclosure, a drum includes: a body having a cylindrical shape; a first drum head that is the drum head, the first drum head being mounted in a one-side opening of the body; and a second drum head mounted in an other-side opening of the body. At least one of the first drum head and the second drum head has a plurality of small holes each of which is less in size than each of the plurality of openings.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIGS. 6A through 6C are graphs illustrating results of measurement of sound pressures produced by drum heads, wherein FIG. 6A is a graph illustrating the result of measurement of sound pressures produced by common heads, FIG. 6B is a graph illustrating the result of measurement of sound pressures produced by the embodiment head, and FIG. 6C is a graph illustrating the result of measurement of sound pressures produced by the comparative-example head;

FIGS. 10A through 10C are views of the snare drum illustrated in FIG. 9, wherein FIG. 10A is a top view of a batter head as a first example, FIG. 10B is a top view of a batter head as a second example, and FIG. 10C is a bottom view of a snare head as one example;

FIGS. 11A through 11C are views of a bass drum including the drum head according to the first embodiment, wherein FIG. 11A is a side view of the bass drum, FIG. 11B is a plan view of a first example of a batter head of the bass drum illustrated in FIG. 11A, and FIG. 11C is a plan view of a second example of a batter head of the bass drum illustrated in FIG. 11A;

DETAILED DESCRIPTION OF THE EMBODIMENTS

First Embodiment

Figure 1A:
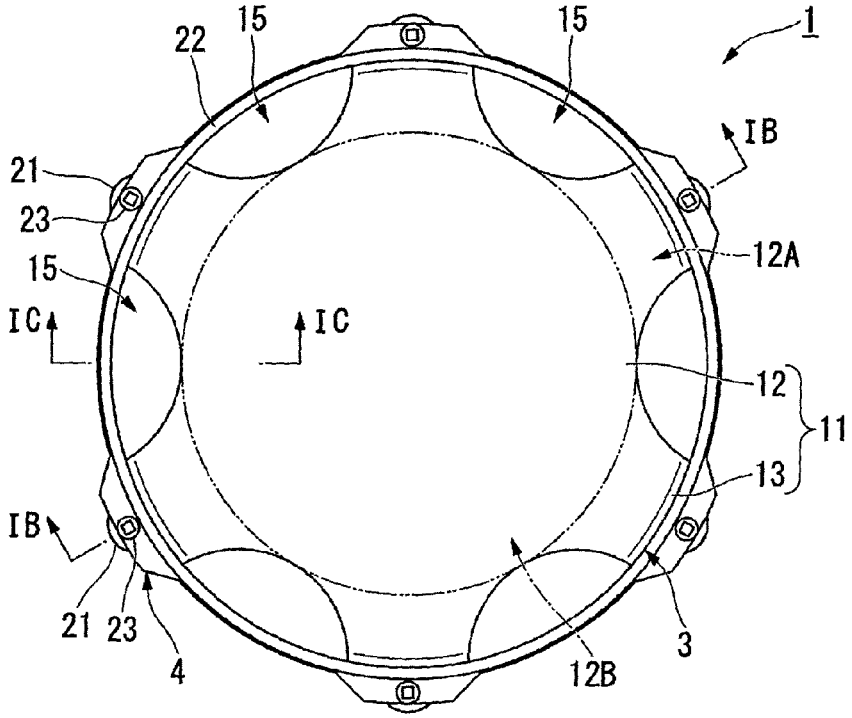
FIG. 1A is a top view of a drum according to a first embodiment.
Figure 1B:
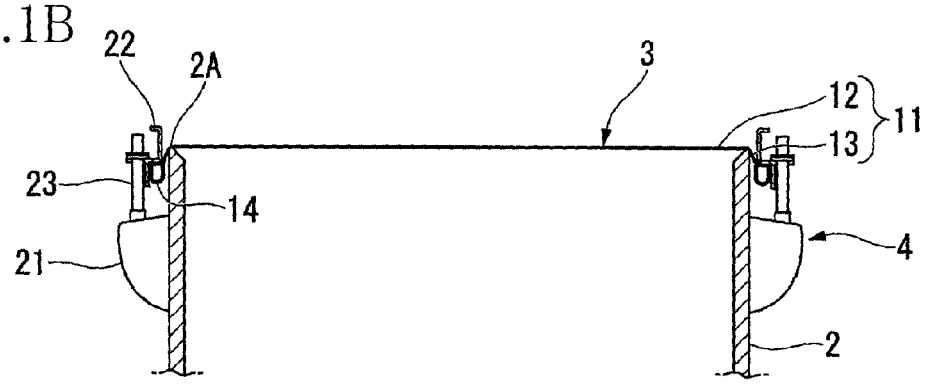
FIG. 1B is a cross-sectional view taken along line IB-IB in FIG. 1A.
Figure 1C:
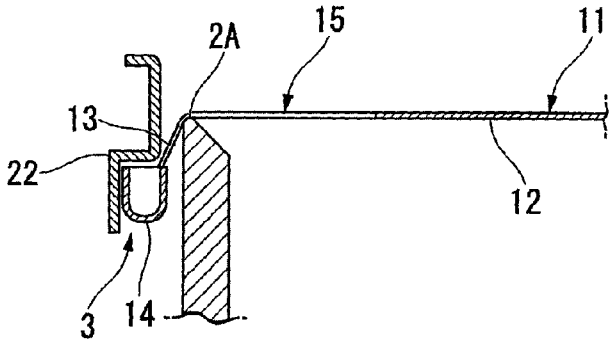
FIG. 1C is a cross-sectional view taken along line IC-IC in FIG. 1A.

Hereinafter, there will be described a first embodiment by reference to FIGS. 1A-6C. As illustrated in FIGS. 1A-2B, a drum 1 according to this first embodiment is a tom. This drum 1 includes a cylindrical shell (a body) 2 and a drum head 3 mounted in one of openings (a one-side opening) of the shell 2 and serving as a striking surface.

The shell 2 is formed of wood or metal, for example. The drum head 3 has a head portion 11 having a round shape in plan view and constituted by a film formed of polyethylene terephthalate (PET), for example. The head portion 11 includes: a round inner (radially-inner) skin 12 provided inside an edge 2A of the one-side opening of the shell 2 in the radial direction of the effective vibration skin 12; and an outer (radially-outer) skin 13 formed integrally with an outer edge of the inner skin 12 and provided outside the edge 2A of the one-side opening of the shell 2 in the radial direction of the effective vibration skin 12. The inner skin 12 effectively vibrates when struck in a state in which the drum head 3 is mounted in the one-side opening of the shell 2. This inner skin 12 may be hereinafter referred to as "effective vibration skin 12".

Figure 2A:
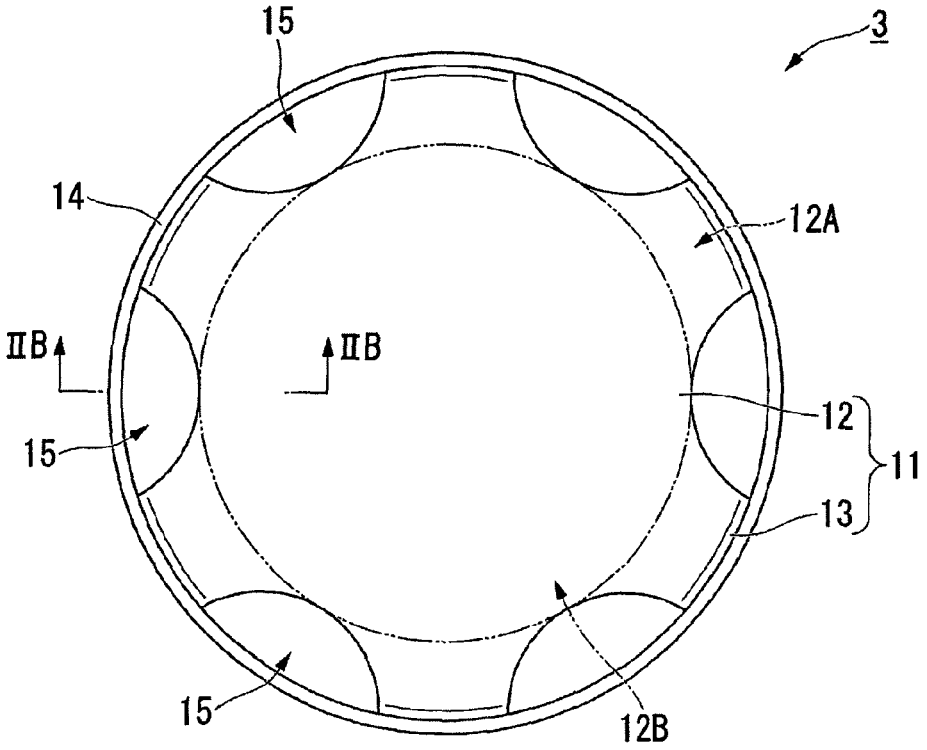
FIG. 2A is a top view of a drum head according to one embodiment.
Figure 2B:
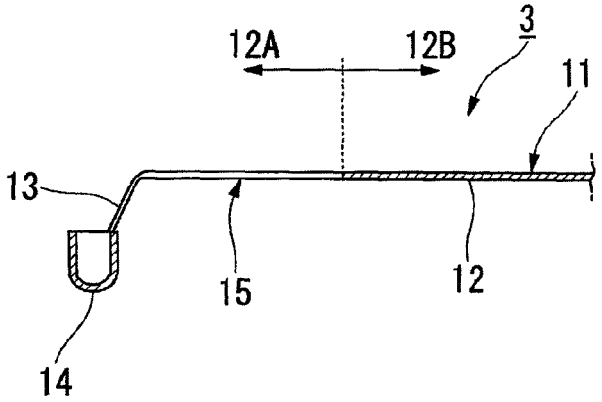
FIG. 2B is a cross-sectional view taken along line IIB-IIB.

In FIG. 2B, also in a state in which the head portion 11 is not mounted on the shell 2, the outer skin 13 extends from an outer edge of the effective vibration skin 12 so as to be inclined in the thickness direction of the effective vibration skin 12, toward an outside in the radial direction of the effective vibration skin 12. However, the present disclosure is not limited this construction. In the present embodiment, the drum head 3 includes a flesh hoop 14 coupled to an outer edge of the head portion 11 (the outer skin 13) to keep the round shape of the head portion 11 in plan view. The inside diameter of the flesh hoop 14 is greater than the outside diameter of the shell 2.

As illustrated in FIG. 1, the drum 1 includes a tensioner 4 that stretches the head portion 11 over the one-side opening of the shell 2 to apply tension to the effective vibration skin 12. In the present embodiment, the tensioner 4 is constituted by a well-known mechanism including lugs 21, a hoop 22, and tension rods (tuning bolts) 23. The tension rods 23 are screwed into the respective lugs 21. The lugs 21 and the tension rods 23 are spaced apart from each other uniformly in the circumferential direction of the shell 2. When the tension rods 23 screwed into the respective lugs 21 are tightened, the hoop 22 urges the flesh hoop 14 of the drum head 3 from the one-side opening of the shell 2 toward the other opening of the shell 2. As a result, tension is applied to the effective vibration skin 12.

In the present embodiment, as illustrated in FIGS. 1A-2B, the effective vibration skin 12 has an outer region 12A and a central region 12B. The outer region 12A is formed with a plurality of openings 15. The outer region 12A is a region which is not to be struck or need not be struck by a player. The central region 12B is a region which is to be struck with drum sticks in the present embodiment. To provide an enough area for the central region 12B, the outer region 12A is preferably provided outside a distance of 75% of the radius of the effective vibration skin 12 from its center in the radial direction, for example.

The plurality of openings 15 are spaced apart from each other uniformly in the circumferential direction of the effective vibration skin 12. In plan view, the outline of each of the openings 15 is curved inward in the radial direction of the effective vibration skin 12. Specifically, an inner end portion of the outline of the opening 15 protrudes and tapers inward in the radial direction. In the present embodiment, an edge of the inner end portion of the outline of the opening 15 in the radial direction has an arc shape. In the present embodiment, the dimension of the opening 15 in the radial direction of the effective vibration skin 12 is less than the dimension of the openings 15 in the circumferential direction of the effective vibration skin 12. In the present embodiment, each opening 15 is formed over a boundary between the effective vibration skin 12 and the outer skin 13. In other words, the opening 15 is formed in both of a portion of the effective vibration skin 12 and a portion of the outer skin 13.

An outer end portion of the opening 15 in the radial direction may reach the flesh hoop 14 as illustrated in FIGS. 1A-2B but may not reach the flesh hoop 14, for example. In the case where the outer end portion of the opening 15 in the radial direction does not reach the flesh hoop 14, the openings 15 can be easily formed after the head portion 11 is mounted on the flesh hoop 14. That is, the drum head 3 can be easily manufactured. In the present embodiment, the plurality of openings 15 have the same shape and the same size. The area of each of the openings 15 in the effective vibration skin 12 is preferably greater than or equal to 78 $mm^2$, for example.

In FIGS. 1A-2B, the number of the openings 15 is equal to each of the number of the lugs 21 and the number of the tension rods 23 of the tensioner 4, but the present disclosure is not limited to this construction. As illustrated in FIG. 1A, the drum head 3 is mounted on the shell 2 such that the openings 15 are not alined with the lugs 21 or the tension rods 23 in the radial direction of the head portion 11, but the present disclosure is not limited to this construction.

In the present embodiment, the drum 1 including the drum head 3 has the plurality of openings 15 that are formed in the effective vibration skin 12. This construction results in a reduced amount of vibration propagating from the drum head 3 to air when the drum head 3 mounted on the shell 2 is struck, making it possible to reduce the volume of a sound produced by a strike on the drum head 3. Also, since the openings 15 are formed in the outer region 12A of the effective vibration skin 12, the area of each opening 15 is large. This construction can reduce or prevent a loss of energy due to increase in velocity of flow of air into and out of the drum 1 through the openings 15. As a result, sustain of sound produced by strike can be brought closer to that in common drum heads (i.e., drum heads not having the openings 15).

The inner end portion of the opening 15 in the radial direction of the effective vibration skin 12 protrudes and tapers inward in the radial direction. With this construction, when tension is applied to the effective vibration skin 12 by the tensioner 4, enough tension can be applied to a portion of the effective vibration skin 12 which is located inside the openings 15 in the radial direction. Thus, when the drum head 3 is struck, unnecessary resonance does not occur at the portion of the effective vibration skin 12 which is located inside the openings 15 in the radial direction. Accordingly, the sustain can be further brought closer to that in the common drum heads, which can prevent deterioration of tone color.

Figure 3A:
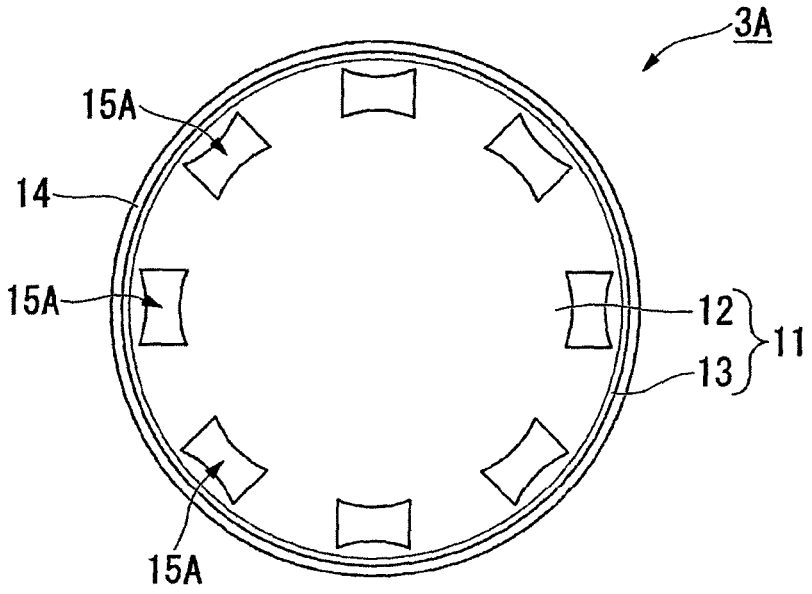
FIGS. 3A and 3B are top views of drum heads as comparative examples.
Figure 3B:
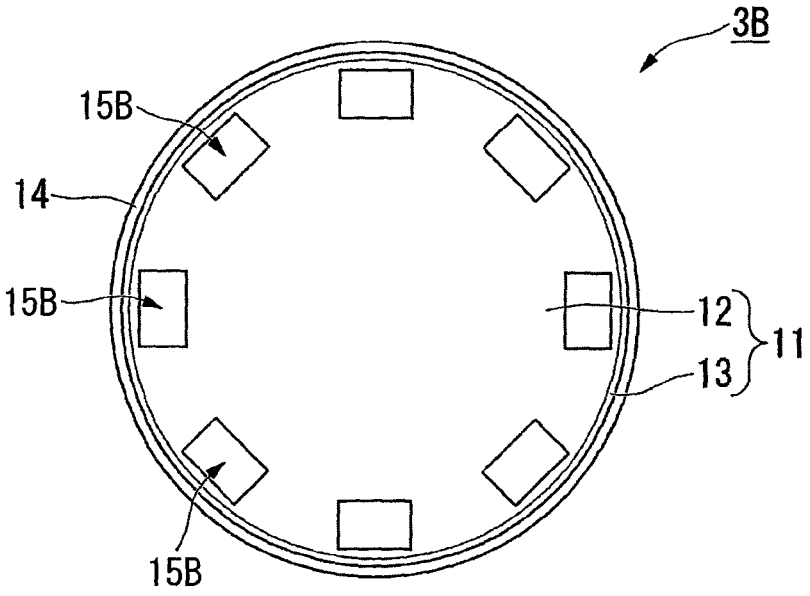

FIGS. 3A and 3B illustrate drum heads 3A, 3B as comparative examples. As illustrated in FIGS. 3A and 3B, the drum head 3A has openings 15A, and the drum head 3B has openings 15B. An inner end portion of each of the openings 15A, 15B in the radial direction of the effective vibration skin 12 does not protrude or taper inward in the radial direction. Specifically, as illustrated in FIG. 3A, the inner end portion of each of the openings 15A in the radial direction is recessed outward in the radial direction of the effective vibration skin 12. As illustrated in FIG. 3B, each of the openings 15B in the radial direction has a rectangular shape, that is, the inner end portion of each of the openings 15A in the radial direction is flat. In the drum heads 3A, 3B, tension cannot be applied to a portion of the effective vibration skin 12 which is located inside the openings 15A, 15B in the radial direction. Thus, when the drum heads 3A, 3B are struck, unnecessary resonance occurs at the portion of the effective vibration skin 12 which is located inside the openings 15A, 15B in the radial direction, resulting in deteriorated tone color. A loss of energy is caused at the portion to which tension is not applied, resulting in reduced sustain.

In the present embodiment, the drum 1 including the drum head 3 can bring the sustain closer to that of the common drum heads to obtain tone color closer to that of the common drum heads, with reduction in volume of sound produced by strike of the drum head 3. This construction allows the drum head 3 to be used not only for practices but also for playing for audience.

In this drum head 3, the plurality of openings 15 are formed in the outer region 12A of the effective vibration skin 12. This construction enables players to strike the central region 12B of the effective vibration skin 12 which does not have the openings 15. Also, durability of the drum head 3 is ensured.

In this drum head 3, an outer end portion of each opening 15 in the radial direction of the effective vibration skin 12 is not located in the effective vibration skin 12. With this construction, the sustain can be brought closer to that of the common drum heads when compared with a construction in which the openings 15 are formed only in the effective vibration skin 12. Also, when compared with the construction in which the openings 15 are formed only in the effective vibration skin 12, the area of each opening 15 the effective vibration skin 12 can be easily increased, with enough area of the central region 12B to be struck with drum sticks. That is, the volume of produced sound can be further reduced.

In this drum head 3, the dimension of the opening 15 in the radial direction of the effective vibration skin 12 is less than the dimension of the opening 15 in the circumferential direction of the effective vibration skin 12. Thus, the area of each opening 15 can be made large with enough area of the central region 12B.

In this drum head 3, the plurality of openings 15 are spaced apart from each other uniformly, that is, the drum head 3 has a symmetric shape. Thus, all the vibrating modes of the struck drum head 3 can be brought closer to the vibrating modes of the common drum heads. Accordingly, the drum head 3 can obtain tone color further closer to that of the common drum heads.

The principal construction of the drum head 3 is similar to that of the common drum heads. Thus, the degree of stretch of the head portion 11 can be tuned with the tensioner 4 in the same manner as that of the common drum heads. Also, both of the common drum head and the drum head 3 can be used for the same shell 2, in other words, the common drum head can be replaced with the drum head 3 for the same shell 2. This construction can reduce the volume of produced sound having tone color depending upon characteristics of the shell 2.

In this drum head 3, the area of each opening 15 can be changed to set the volume of a desired sound. For example, the area of each opening 15 can be increased to reduce the volume of produced sound. Accordingly, various kinds of drum heads 3 having different sizes of the openings 15 can be prepared, and a player can select one of the drum heads 3 which produces a volume of sound which is required for playing.

Figure 4:
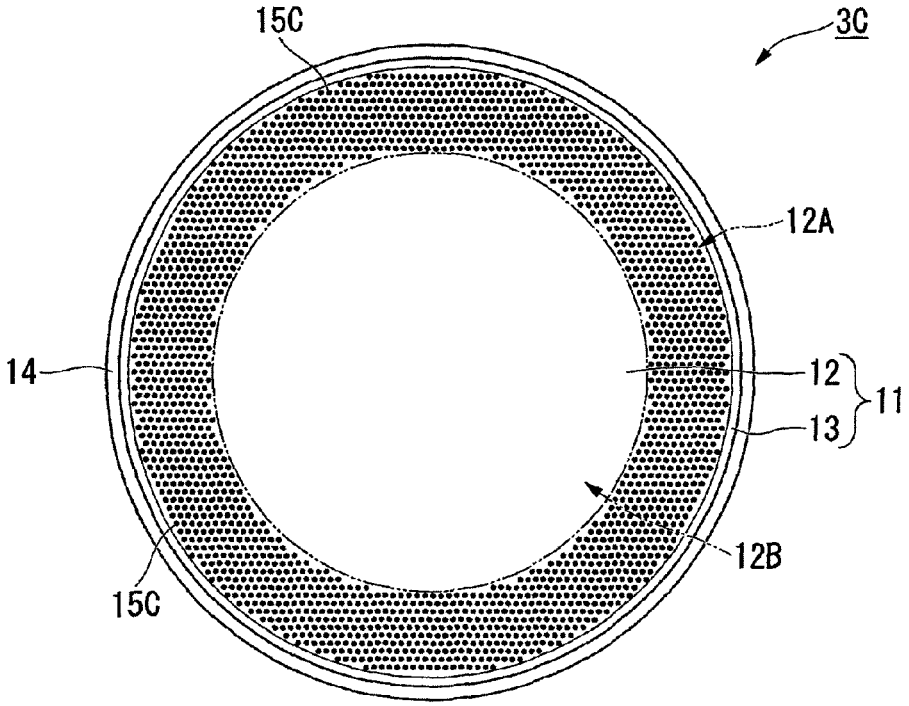
FIG. 4 is a top view of a drum head as a comparative example.

There will be next explained the above-described effects of the drum head 3 by taking the following experiment as one example. This experiment compares the drum head 3 with the common drum heads not having the openings 15 (which may be hereinafter referred to as "common heads") and a drum head 3C, as a comparative example, which has a multiplicity of small holes 15C formed in the outer region 12A of the effective vibration skin 12 as illustrated in FIG. 4. The area of each of the small holes 15C is 7 $mm^2$ It is noted that the drum head 3 according to the present embodiment and the drum head 3C may be hereinafter referred to as "embodiment head 3" and as "comparative-example head 3C", respectively.

Figure 5:
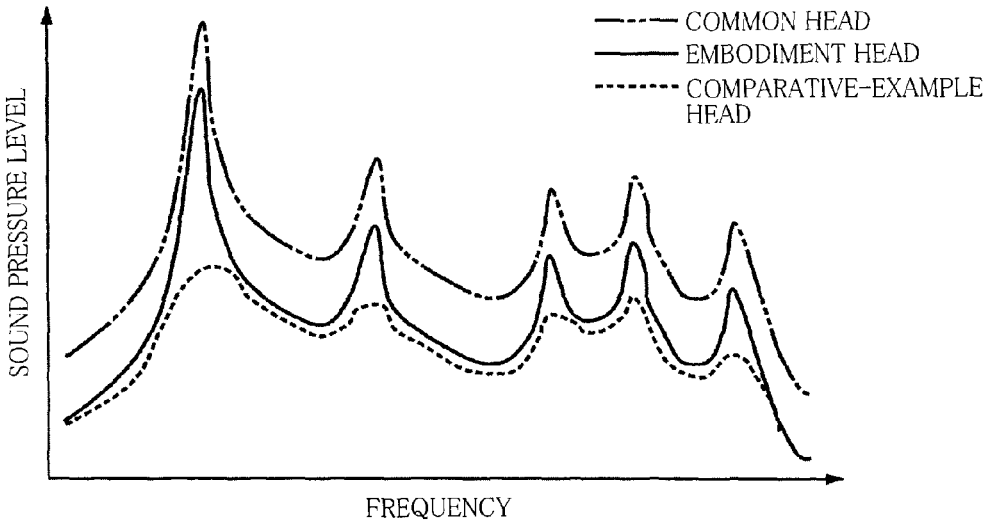
FIG. 5 is a graph illustrating frequency characteristics of sound pressure levels in the embodiment head illustrated in FIG. 2, the comparative-example head illustrated in FIG. 4, and common heads.

FIG. 5 illustrates frequency characteristics of sounds produced by strike of the embodiment head 3 illustrated in FIG. 2, the common head, not illustrated, and the comparative-example head 3C illustrated in FIG. 4 under the same conditions. As illustrated in FIG. 5, a plurality of peaks occur in the frequency characteristics of sound produced by the common head. The peak of the lowest frequency indicates fundamental tone of the produced sound, and the peaks of the other freaquencies indicates overtones of the produced sound.

The peaks similar to those in the common head also occur in the frequency characteristics of sound produced by the embodiment head 3 and the comparative-example head 3C. In the comparative-example head 3C, however, the magnitude of the sound pressure level at each peak is considerably lower than that in the common head. The acuteness at each peak is considerably less in the comparative-example head 3C than in the common head. That is, a fundamental tone and overtones are not emphasized in sounds produced by the comparative-example head 3C. This indicates that the comparative-example head 3C produces unnatural tone color in which sustain is extremely short, and only attack is emphasized.

In the embodiment head 3, in contrast, the magnitude of the sound pressure level at each peak is lower than that in the common head. However, the difference in the magnitude between the embodiment head 3 and the common head is considerably less than the difference in the magnitude between the comparative-example head 3C and the common head. The acuteness at each peak in the embodiment head 3 is closer to that in the common head than that in the comparative-example head 3C. That is, fundamental tone and overtones are emphasized in sounds produced by the embodiment head 3 as in the common head. This indicates that the embodiment head 3 produces natural tone color with a relatively long sustain.

Figure 6A:
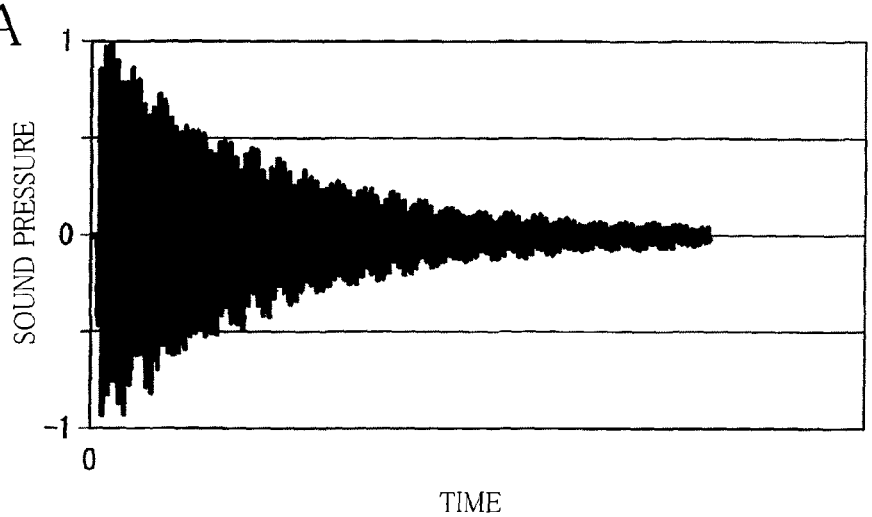
Figure 6B:
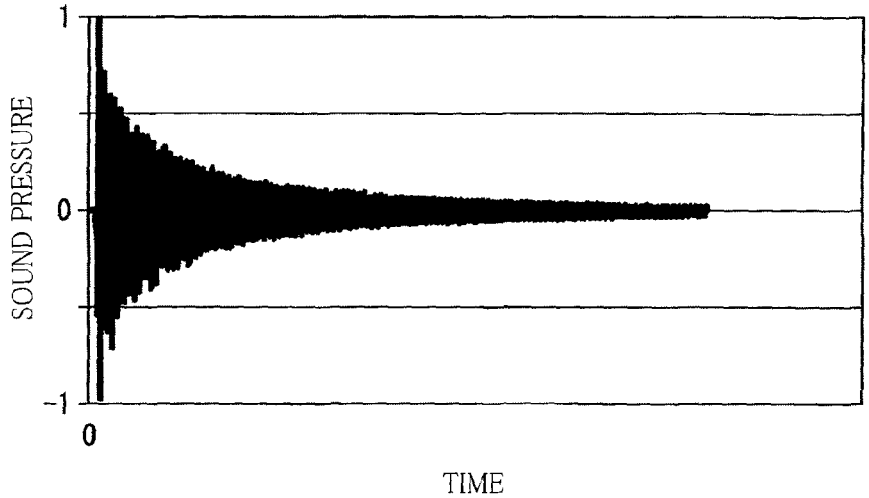
Figure 6C:
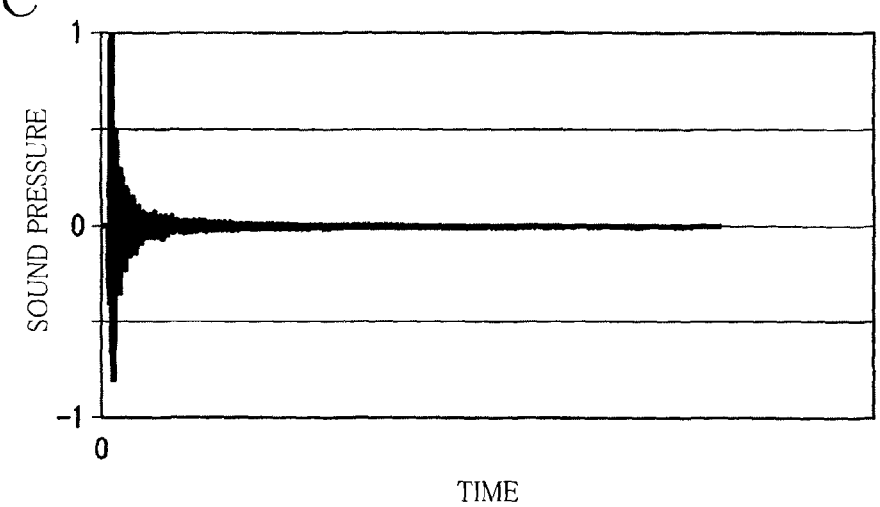

Differences in sustain between the embodiment head 3 and the comparative-example head 3C is obvious as illustrated in FIGS. 6A-6C. FIGS. 6A-6C illustrate changes in pressures of sounds produced by strike on the common head, the embodiment head 3, and the comparative-example head 3C under the same condition. The sound pressure in each of the graphs in FIGS. 6A-6C does not represent the magnitude of absolute sound pressure. Instead, each graph sets one as the highest value of the sound pressure in a corresponding one of the drum heads.

As illustrated in FIGS. 6A-6C, the sound pressure is highest at the moment of strike and lowers with time in any of the common head, the embodiment head 3, and the comparative-example head 3C. In the comparative-example head 3C illustrated in FIG. 6C, however, the sound pressure sharply lowers just after strike, when compared with the common head illustrated in FIG. 6A. That is, the comparative-example head 3C produces unnatural tone color in which sustain is extremely short, and only attack is emphasized. In the embodiment head 3 illustrated in FIG. 6B, in contrast, the degree of lowering of the sound pressure is greater than that in the common head but considerably less than that in the comparative-example head 3C. That is, the sound produced by the embodiment head 3 has natural tone color with a relatively long sustain.

The following consideration can be provided for a reason why the tone color differs between the embodiment head 3 and the comparative-example head 3C. When the effective vibration skin 12 of the embodiment head 3 or the comparative-example head 3C is struck and vibrated, air flows into and out of the shell 2 through the openings 15 (and the small holes 15C in the case of the comparative-example head 3C). Here, when the area of opening is considerably small like the area of each of the small holes 15C of the comparative-example head 3C, for example, the velocity of flow of air increases greatly when the air passes through the small holes 15C, thereby causing a loss of energy due to the principle of an orifice. This loss of energy hinders natural vibration of the effective vibration skin 12, so that the vibrating manner of the effective vibration skin 12 greatly differs between the comparative-example head 3C and the common head.

In contrast, in the case where the area of opening is relatively large like the area of each of the openings 15 of the embodiment head 3, that is, in the case where the area of opening is greater than or equal to 78 $mm^2$, for example, an amount of increase in velocity of flow of air when the air passes through the openings 15 is small when compared with the case of the comparative-example head 3C, or the velocity of flow of air does not increase when the air passes through the openings 15. As a result, it is possible to reduce the loss of energy due to the principle of an orifice or prevent generation of the loss of energy. This reduction or prevention can keep the natural vibration of the effective vibration skin 12 of the embodiment head 3 or bring the vibrating manner of the effective vibration skin 12 of the embodiment head 3 closer to the vibrating manner of the effective vibration skin 12 of the common head. In view of the above, the area of each opening 15 formed in the effective vibration skin 12 is preferably set to be large enough to reduce an amount of increase in velocity of flow of air into and out of the shell 2 through the openings 15 when the effective vibration skin 12 is struck.

The highest sound pressure level (i.e., the greatest volume) of the sound produced by strike was measured for the common head, the embodiment head 3, and the comparative-example head 3C under the same conditions. The highest sound pressure level was the highest in the common head, with that in the comparative-example head 3C and that in the embodiment head 3 following in this order. That is, it was found that the volume of the sound produced by strike was reduced more effectively in the embodiment head 3 than in the comparative-example head 3C. It is possible to consider that the sound volume is reduced because the openings 15 formed in the effective vibration skin 12 reduce the effective area of the effective vibration skin 12 which vibrates and radiates sound.

Figure 7A:
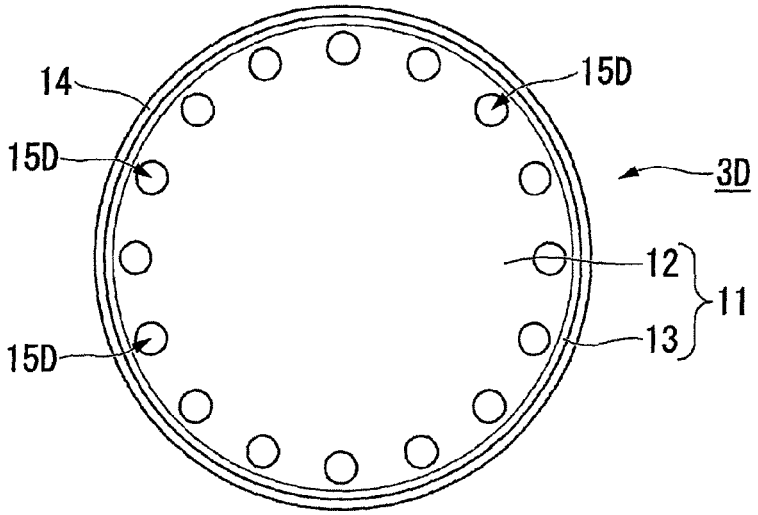
FIGS. 7A through 7C are top views of drum heads according to modifications of the first embodiment.
Figure 7B:
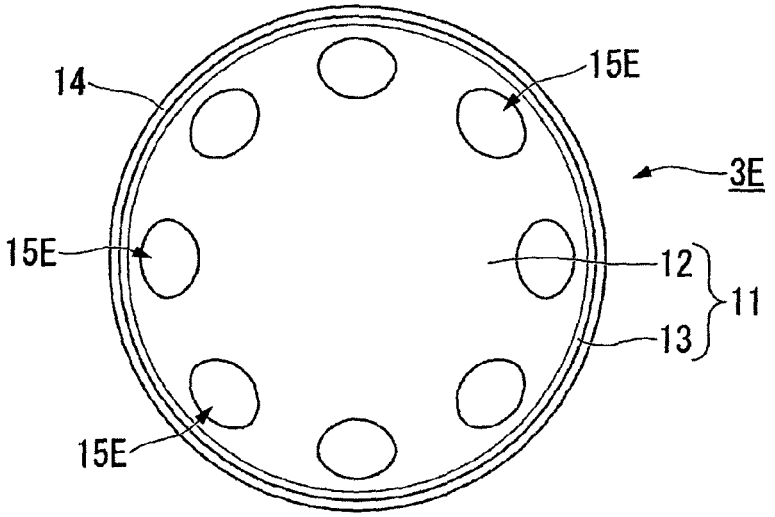
Figure 7C:
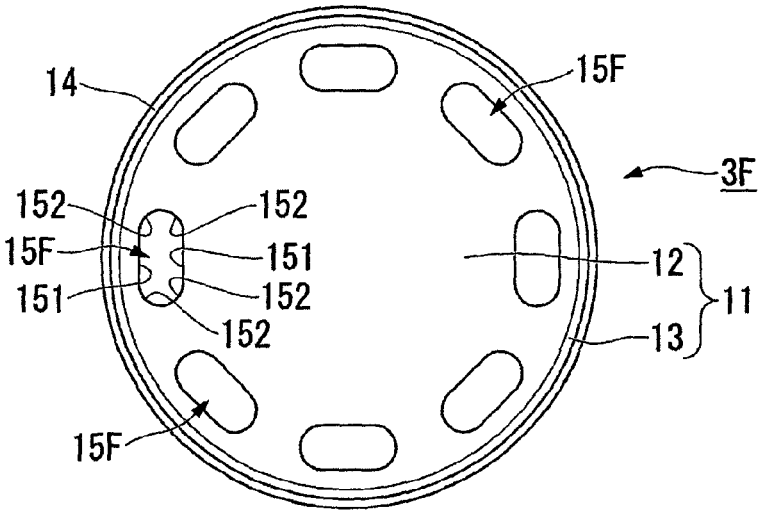

FIGS. 7A-7C illustrate drum heads 3D, 3E, 3F according to modifications of the first embodiment. As illustrated in FIGS. 7A-7C, each of the drum heads 3D, 3E, 3F has corresponding openings 15D, 15E, 15F formed only in the effective vibration skin 12. An outer end portion of each of the openings 15D, 15E, 15F in the radial direction of the effective vibration skin 12 in plan view preferably protrudes and tapers outward in the radial direction. In these constructions, when tension is applied to the effective vibration skin 12 by, e.g., the tensioner 4 (see FIGS. 1A-1C), enough tension can be applied also to a portion of the effective vibration skin 12 which is located outside the openings 15D, 15E, 15F in the radial direction. Thus, when each of the drum heads 3D, 3E, 3F is struck, unnecessary resonance does not occur at a portion of the effective vibration skin 12 which is located inside the openings 15D, 15E, 15F in the radial direction, which can prevent deterioration of tone color.

As illustrated in FIGS. 3A and 3B, the openings 15A and the openings 15B are formed only in the effective vibration skin 12. An outer end portion of each of the openings 15A, 15B in the radial direction of the effective vibration skin 12 does not protrude or taper inward in the radial direction. Specifically, as illustrated in FIG. 3A, the outer end portion of each of the openings 15A in the radial direction is recessed inward in the radial direction of the effective vibration skin 12. As illustrated in FIG. 3B, each of the openings 15B in the radial direction has the rectangular shape, that is, the outer end portion of each of the openings 15A in the radial direction is flat. In these drum heads 3A, 3B, enough tension cannot be applied to a portion of the effective vibration skin 12 which is located outside the openings 15A, 15B in the radial direction in some cases. Thus, when the drum heads 3A, 3B are struck, unnecessary resonance may occur at the portion of the effective vibration skin 12 which is located outside the openings 15A, 15B in the radial direction, which may deteriorate tone color.

Each of the openings 15D formed only in the effective vibration skin 12 may have a round shape in plan view as illustrated in FIG. 7A. Each of the openings 15E formed only in the effective vibration skin 12 may have an oval shape in plan view as illustrated in FIG. 7B. As illustrated in FIGS. 7A and 7B, the shape of an edge of an inner end portion of each of the openings 15D, 15E in the radial direction of the effective vibration skin 12 may be an arc shape. As illustrated in FIG. 7C, an edge of an inner end portion of each of the openings 15F in the radial direction of the effective vibration skin 12 may include a straight portion 151 and a pair of inclined portions 152. The straight portion 151 extends in a direction perpendicular to the radial direction of the effective vibration skin 12. The inclined portions 152 extend respectively from opposite ends of the straight portion 151. The distance between the inclined portions 152 in the circumferential direction of the effective vibration skin increases with increase in distance from the straight portion 151 in the radial direction. As illustrated in FIGS. 7A and 7B, the shape of an edge of an outer end portion of each of the openings 15D, 15E in the radial direction of the effective vibration skin 12 may be an arc shape. Like the edge of the inner end portion, as illustrated in FIG. 7C, an edge of an outer end portion of each of the openings 15F in the radial direction of the effective vibration skin 12 may include a straight portion 151 and a pair of inclined portions 152.

In the case where the openings 15E, 15F in each of which the length and the width differ from each other are formed as illustrated in FIGS. 7B and 7C, the dimension of each of the openings 15E, 15F in the radial direction of the effective vibration skin 12 is preferably less than that in the circumferential direction of the effective vibration skin 12.

The same effects as achieved in the first embodiment can be achieved by the drum heads 3D, 3E, 3F having the openings 15D, 15E, 15F formed only in the effective vibration skin 12. That is, sustain can be brought closer to that of the common drum heads to obtain tone color closer to that of the common drum heads, with reduction in volume of sound produced by strike of each of the drum heads 3D, 3E, 3F.

Figure 8:
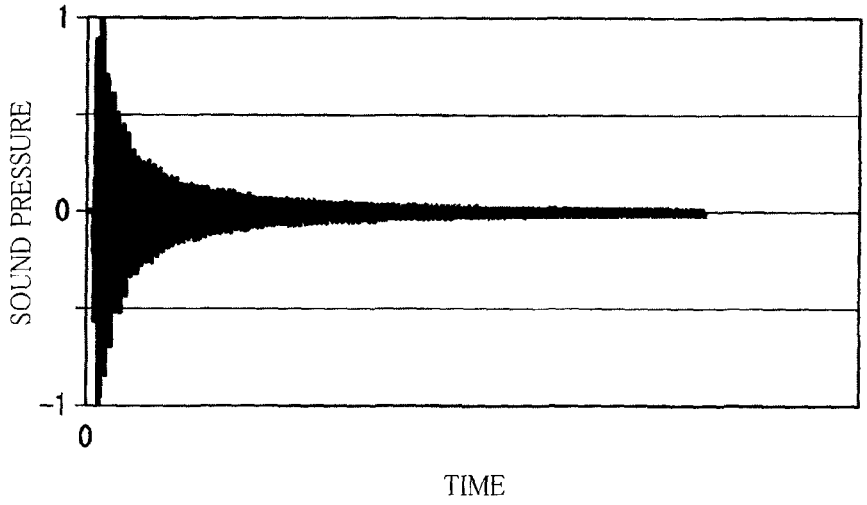
FIG. 8 is a graph illustrating the result of measurement of sound pressures produced by the drum head illustrated in FIG. 7A.

There will be next explained the effects achieved by the drum heads 3D, 3E, 3F with reference to FIG. 8. FIG. 8 illustrates changes in pressures of sounds produced by strike of the drum head 3D illustrated in FIG. 7A (hereinafter may be referred to as "modification head 3D") under conditions that are the same as the above-described conditions for the common head, the embodiment head 3 (see FIGS. 2A and 2B), and the comparative-example head 3C (see FIG. 4).

As illustrated in FIG. 8, the degree of lowering of the sound pressure in the modification head 3D is greater than that in the common head illustrated in FIG. 6A but considerably less than that in the comparative-example head 3C illustrated in FIG. 6C. That is, the sound produced by the modification head 3D has natural tone color with a relatively long sustain. However, the degree of lowering of the sound pressure in the modification head 3D is greater than that in the embodiment head 3 illustrated in FIG. 6B. That is, the sustain of sound produced by the modification head 3D is shorter than the sustain of sound produced by the embodiment head 3. Accordingly, the openings are preferably formed over the boundary between the effective vibration skin 12 and the outer skin 13 than only in the effective vibration skin 12.

The plurality of openings formed in the head portion 11 are arranged in a single line in the circumferential direction of the effective vibration skin 12 in the first embodiment but may be arranged in a plurality of lines, for example. In the case where the openings are arranged in a plurality of lines, the plurality of openings may be arranged such that the openings arranged in one of the lines are adjacent to the openings arranged in another line in the radial direction of the effective vibration skin 12 and may be arranged in, e.g., a staggered configuration such that openings arranged in one of the lines are not adjacent to the openings arranged in another line in the radial direction of the effective vibration skin 12.

Figure 9:
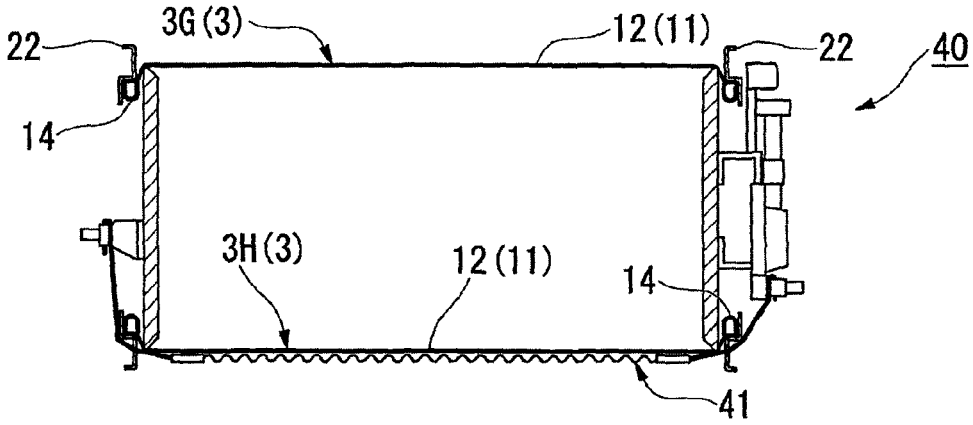
FIG. 9 is a side elevational view in cross section illustrating a snare drum including the drum head according to the first embodiment.
Figure 10A:
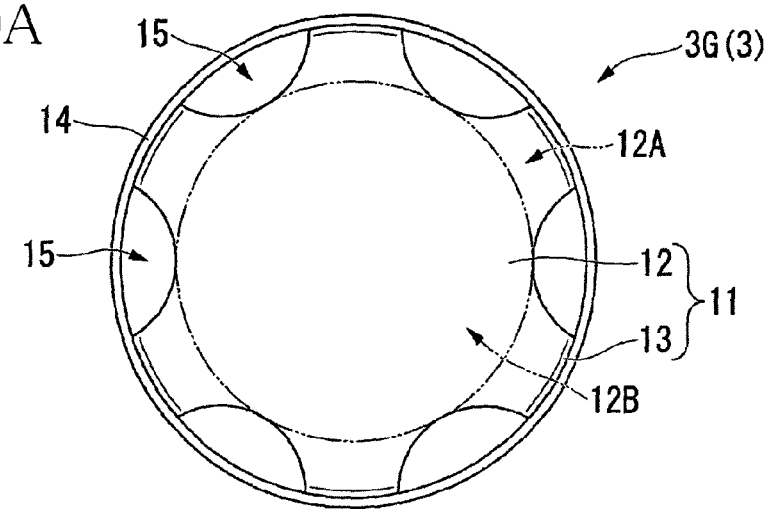
Figure 10B:
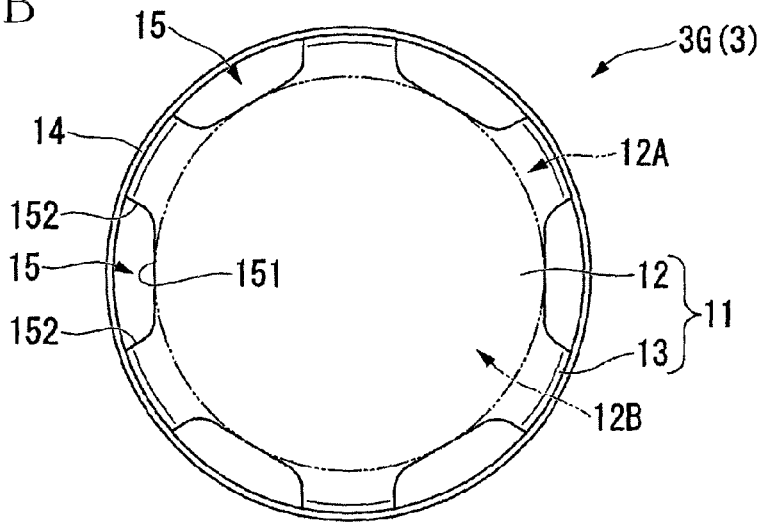
Figure 10C:
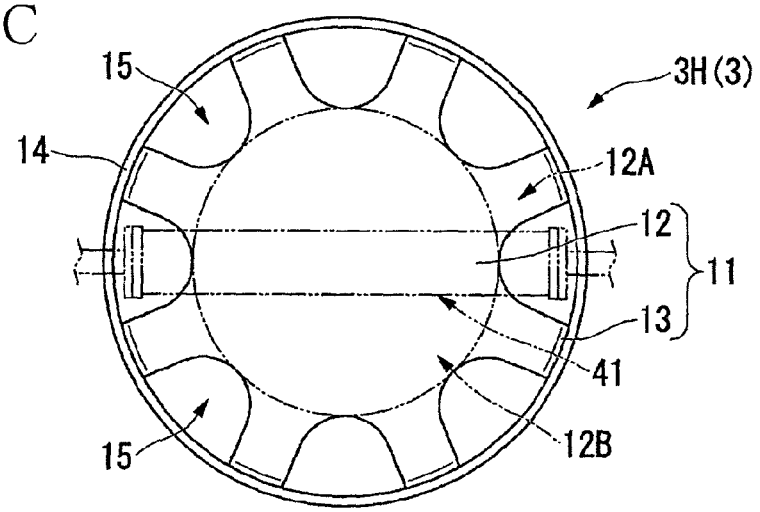

The drum head 3 in the first embodiment may be applied to a snare drum (a drum) 40 as illustrated in FIGS. 9-10C. In this case, the drum head 3 in the first embodiment is preferably provided as at least a batter head 3G of the snare drum 40. Also, the drum head 3 in the first embodiment may be provided as a snare head 3H to be struck with a snare wire 41, for example. This construction can reduce the volume of sound produced by striking the effective vibration skin 12 of the snare head 3H with the snare wire 41.

To provide an enough area for the central region 12B to be struck with the drum sticks, as in the first embodiment, the outer region 12A formed with the openings 15 of the batter head 3G is preferably provided outside the distance of 75% of the radius of the effective vibration skin 12 from its center in the radial direction, for example. The snare head 3H only needs to have a region to be struck with the snare wire 41. Thus, the diameter of the central region 12B of the snare head 3H may be less than that of the central region 12B of the batter head 3G, for example. In other words, the distance between the center of the head portion 11 and an inner edge of the outer region 12A on the snare head 3H may be less than the distance between the distance between the center of the head portion 11 and an inner edge of the outer region 12A on the batter head 3G. In the snare drum 40, the number of the openings 15 formed in the batter head 3G and the number of the openings 15 formed in the snare head 3H may differ from each other as illustrated in FIGS. 10A-10C but may be equal to each other.

In the snare drum 40, the drum head in the first embodiment is used for both of the batter head 3G and the snare head 3H. The volume of sound produced by the batter head 3G and the volume of sound produced by the snare head 3H can be reduced in balance, with natural tone color ensured.

In the batter head 3G, as illustrated in FIG. 10A, the shape of an edge of an inner end portion of each of the openings 15 in the radial direction may be an arc shape. Instead, as illustrated in FIG. 10B, the edge of an inner end portion of each opening 15 may include a straight portion 151 and a pair of inclined portions 152. The straight portion 151 extends in the direction perpendicular to the radial direction of the effective vibration skin 12. The inclined portions 152 extend respectively from opposite ends of the straight portion 151. The distance between the inclined portions 152 in the circumferential direction of the effective vibration skin increases with increase in distance from the straight portion 151 in the radial direction. In the case of the openings 15 in FIG. 10B, when compared with the openings 15 in FIG. 10A, the area of each opening 15 can be made larger even in the case where the diameter of the outer region 12A of the batter head 3G is small. This construction can increase the area of the central region 12B to be struck with the drum sticks. That is, the shape of each opening 15 illustrated in FIG. 10B is preferable for the batter head 3G.

Figure 11A:
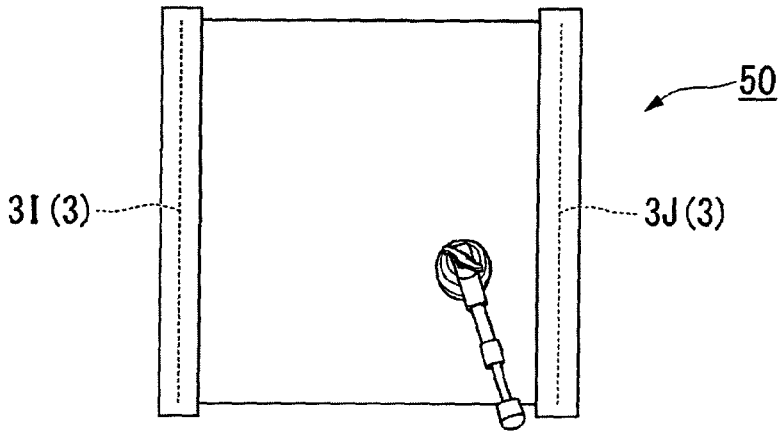
Figure 11B:
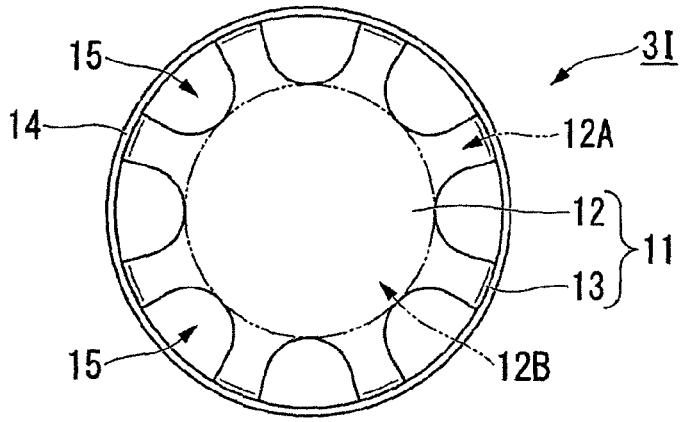
Figure 11C:
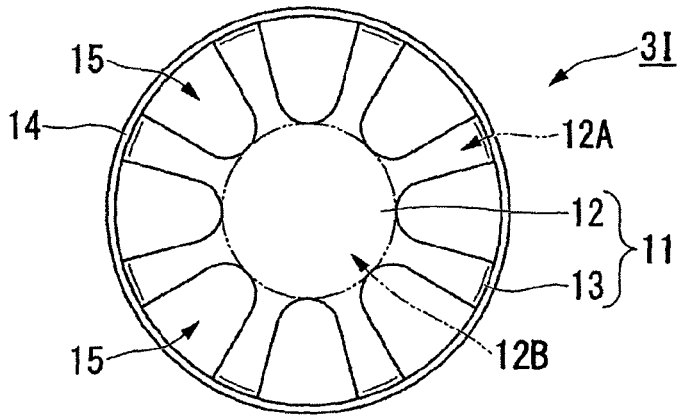

The drum head 3 in the first embodiment may be applied to a bass drum (a drum) 50 as illustrated in FIGS. 11A-11C. In this case, the drum head 3 in the first embodiment is preferably provided as a batter head 3I of the bass drum 50.

The batter head 3I of the bass drum 50 is struck with a foot pedal, not illustrated. A striking position is in most cases predetermined in the batter head 3I. Thus, the diameter of the central region 12B of the batter head 3I of the bass drum 50 (i.e., the distance between the center of the head portion 11 and an inner edge of the outer region 12A of the batter head 3I of the bass drum 50) may be large as illustrated in FIG. 11B and may be small as illustrated in FIG. 11C. That is, the batter head 3I of the bass drum 50 may have the openings 15 each with a large area to greatly reduce the central region 12B to be struck with the foot pedal. The outer region 12A formed with the openings 15 of the batter head 3I of the bass drum 50 is preferably provided outside a distance of 64% of the radius of the effective vibration skin 12 from its center in the radial direction, for example. Also, the outer region 12A of the batter head 31 may be provided outside a distance of 40% of the radius of the effective vibration skin 12 from its center in the radial direction, for example.

The same effects as achieved in the first embodiment can be achieved by the bass drum 50 including the batter head 3I to which the drum head according to the first embodiment is applied. That is, the volume of sound produced by the batter head 3I can be effectively reduced while ensuring natural tone color. Front heads 3J of various kinds and mute components, not illustrated, can be combined as needed to tune tone color of sounds produced by the bass drum 50, as in the case where common batter heads not having the openings 15 are used.

Second Embodiment

Figure 12:
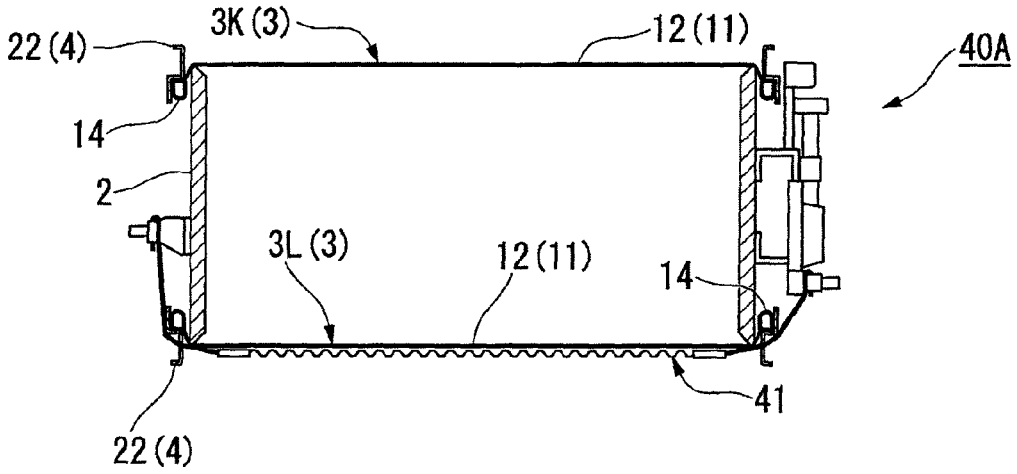
FIG. 12 is a side elevational view in cross section illustrating a snare drum according to a second embodiment.
Figure 13A:
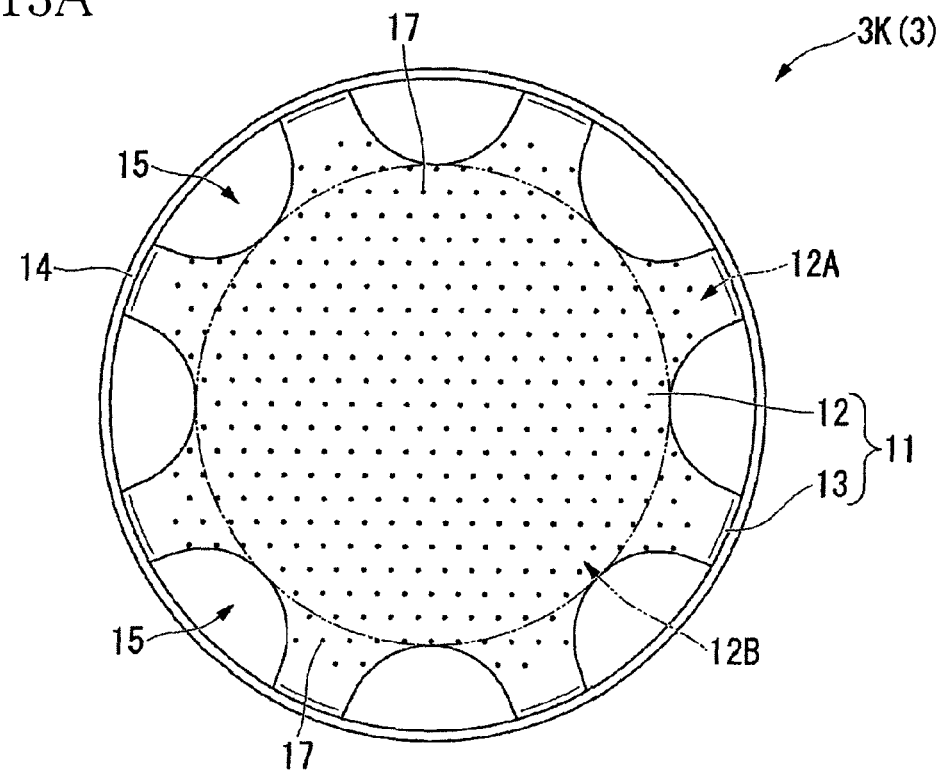
FIG. 13A is a top view of a batter head of the snare drum illustrated in FIG. 12.
Figure 13B:
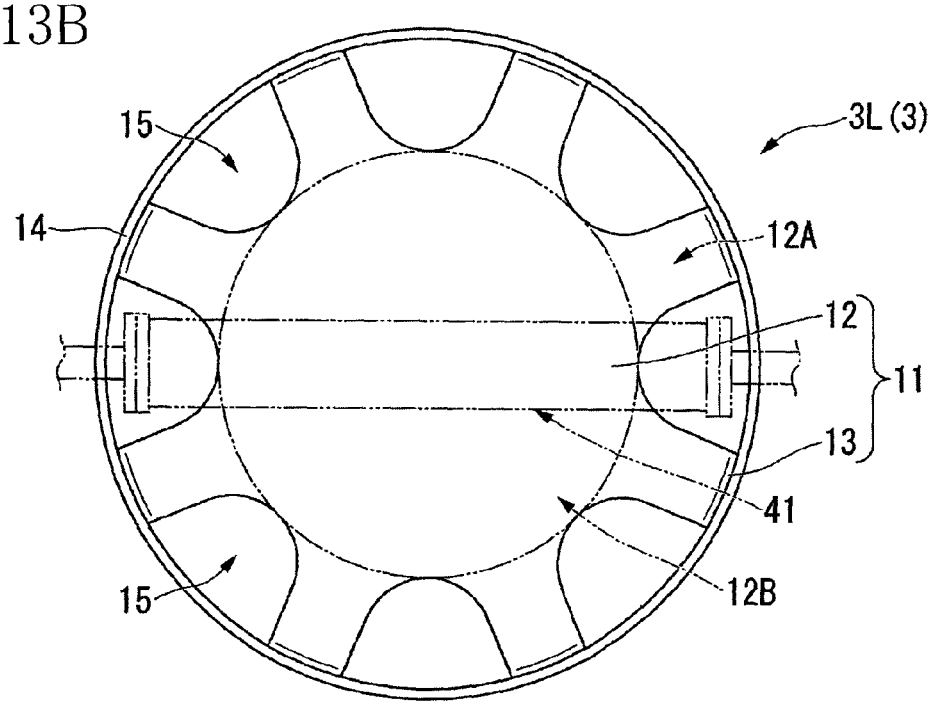
FIG. 13B is a bottom view of a snare head of the snare drum illustrated in FIG. 12.
Figure 14:
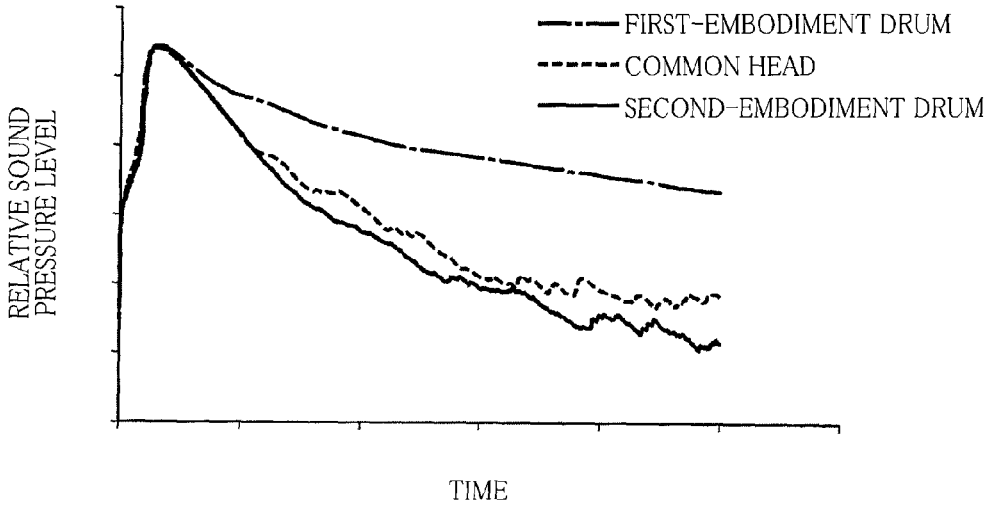
FIG. 14 is a graph illustrating relative changes of sound pressure levels with time in common drums, the first-embodiment drum, and the second-embodiment drum illustrated in FIGS. 12 through 13B.

There will be next explained a second embodiment with reference to FIGS. 12-14. It is noted that the same reference numerals as used in the first embodiment are used to designate the corresponding elements of this second embodiment, and an explanation of which is dispensed with.

As illustrated in FIGS. 12-13B, a drum according to this embodiment is a snare drum 40A similar to the snare drums illustrated in FIGS. 9-10C. This drum includes: the cylindrical shell (the body) 2; a batter head 3K (as one example of a first drum head) mounted in one of opposite openings of the shell 2; a snare head 3L (as one example of a second drum head) mounted in the other of the opposite openings of the shell 2; and the snare wire 41 to be selectively pressed onto the snare head 3L. Each of the batter head 3K and the snare head 3L includes the head portion 11 and the flesh hoop 14 each having the same construction as that of the drum head 3 in the first embodiment. Like the drum 1 according to the first embodiment, the snare drum 40A according to the present embodiment includes the tensioners 4, each of which stretches the head portion 11 of a corresponding one of the batter head 3K and the snare head 3L over the corresponding opening of the shell 2 to apply tension to the effective vibration skin 12.

The plurality of openings 15 similar to those in the first embodiment are formed in the outer region 12A of the effective vibration skin 12 of each of the batter head 3K and the snare head 3L. The number of the openings 15 formed in the batter head 3K and the number of the openings 15 formed in the snare head 3L may be equal to each other as illustrated in FIG. 13 but may differ from each other.

In the present embodiment, small holes (minute holes) 17 are formed in the effective vibration skin 12 of the batter head 3K. Each of the small holes 17 is smaller than each of the openings 15. The area of each of the small holes 17 is preferably greater than or equal to 0.7 $mm^2$ and less than or equal to 30 $mm^2$, for example. The small holes 17 are formed in the entire effective vibration skin 12 except the portion of the effective vibration skin 12 in which the openings 15 are formed. As illustrated in FIG. 13A, the small holes 17 are not formed near a portion of the effective vibration skin 12 near a boundary between the effective vibration skin 12 and the outer skin 13. However, the small holes 17 may be formed near the portion. The small holes 17 are not formed in the snare head 3L in the present embodiment.

The same effects as achieved in the first embodiment can be achieved by the snare drum 40A including the batter head 3K. In the batter head 3K and the snare drum 40A according to the present embodiment, the small holes 17 are formed in the effective vibration skin 12. This construction increases the loss of energy due to increase in velocity of flow of air into and out of the snare drum 40A through the small holes 17, when the effective vibration skin 12 of the batter head 3K mounted on the shell 2 is struck and vibrated. That is, since the air flows into and out of the snare drum 40A through the small holes 17, vibration of the batter head 3K is reduced. This reduction in vibration can shorten sustain of sound produced by strike when compared with the batter head 3K only with the openings 15 (without the small holes 17). In particular, it is possible to shorten sustain in vibrating mode in a low frequency range (e.g., a frequency range of 100 to 800 Hz). For snare drums, tight sounds are generally requested in most cases. Thus, it is effective to shorten the sustain in the low frequency range (the fundamental tone in particular) by forming the small holes 17 as in the snare drum 40A. Also, in the batter head 3K and the snare drum 40A according to the present embodiment, it is possible to adjust the sustain by adjusting the number of the small holes 17 formed in the effective vibration skin 12. For example, the number of the small holes 17 is increased for shortening the sustain.

The effects achieved by the snare drum 40A according to the present embodiment will be explained by comparing the snare drum 40A with common snare drums (hereinafter may be referred to as "common drums") having a batter head and a snare head not formed with the openings 15 or the small holes 17, and the snare drum 40 (hereinafter may be referred to as "first-embodiment drum 40") having the batter head 3G and the snare head 3H each formed only with the openings 15 as illustrated in FIGS. 9-10C. It is noted that the snare drum 40A according to the present embodiment may be hereinafter referred to as "second-embodiment drum 40A".

An equivalent noise level was measured for each of the second-embodiment drum 40A, the common drum, and the first-embodiment drum 40 by striking the batter head thereof under the same conditions. The result of this measurement indicates that the respective equivalent noise levels in the case of the first-embodiment drum 40 and the second-embodiment drum 40A are generally equal to each other. Each of these equivalent noise levels is lower than the equivalent noise level in the case of the common drum. That is, the first-embodiment drum 40 and the second-embodiment drum 40A can reduce the volume of sound produced by strike, when compared with the common drum. It is possible to consider that the sound volume is reduced mainly because the openings 15 formed in the effective vibration skin 12 reduce the effective area of the effective vibration skin 12 which vibrates and radiates sound. It is possible to further consider that the sound volume is reduced secondarily because reduction in radiation of sound from one of the batter head and the snare head reduces responses of the other head, resulting in reduction in radiation of sound produced from the other head.

Furthermore, frequency characteristics of sound produced by the common drum, the first-embodiment drum 40, and the second-embodiment drum 40A are measured. The result of this measurement indicates that a plurality of peaks indicating the fundamental tone and the overtones appear in any of the drums, but the acuteness at each peak in the low frequency range (e.g., the frequency range of 100 to 800 Hz) varies between the first-embodiment drum 40 and each of the common drum and the second-embodiment drum 40A.

The acuteness at each peak in the first-embodiment drum 40 is greater than that in the common drum and the second-embodiment drum 40A. This means that the sustain of the sound produced by the first-embodiment drum 40 is longer than the sustain of the sounds produced by the common drum and the second-embodiment drum 40A. The acuteness at each peak in the second-embodiment drum 40A is generally equal to that in the common drum. This means that the sustain of the sound produced by the second-embodiment drum 40A is close to that of the sound produced by the common drum. In other words, tone color of the second-embodiment drum 40A is closer to that of the common drum than that of the first-embodiment drum 40.

The sustain of sound produced by each of the drums will be explained with reference to FIG. 14. FIG. 14 illustrates changes in relative sound pressure levels of sounds produced by strike of the common drum, the first-embodiment drum 40, and the second-embodiment drum 40A under the same conditions. FIG. 14 illustrates changes in fundamental tone (i.e., sounds near 200 Hz) of the produced sounds by way of example. Also, in the graph in FIG. 14, the highest sound pressure levels of the respective fundamental tones are set to the same value in the common drum, the first-embodiment drum 40, and the second-embodiment drum 40A. As illustrated in FIG. 14, in each of the common drum, the first-embodiment drum 40, and the second-embodiment drum 40A, the sound pressure level of the fundamental tone (the produced sound) at the moment of strike is highest and thereafter attenuates with time.

In the first-embodiment drum 40, however, a degree of attenuation of the sound pressure level of the fundamental tone (the produced sound) after strike is smaller than that in the common drum and the second-embodiment drum 40A. That is, the sustain of the fundamental tone (the produced sound) in the first-embodiment drum 40 is longer than that in the common drum and the second-embodiment drum 40A. In the second-embodiment drum 40A, in contrast, the degree of attenuation of the sound pressure level of the fundamental tone (the produced sound) after strike is slightly larger than that in the common drum but more similar to that in the common drum than that in the first-embodiment drum 40. That is, the sustain of the fundamental tone (the produced sound) produced by the first-embodiment drum 40 is close to that in the common drum.

The following consideration can be provided for the reason why the sustain differs between the first-embodiment drum 40 and each of the common drum and the second-embodiment drum 40A, for example. The common drums do not have the openings 15 or the small holes 17. Thus, when the effective vibration skins 12 of the batter head and the snare head are vibrated by striking the batter head of the common drum, the air never flows into and out of the shell 2 through the heads. Also, the snare wire 41 is pressed onto the snare head, facilitating attenuation of the vibration of the effective vibration skin 12 of the snare head. These conditions limit the vibration of the effective vibration skin 12 of the batter head in some vibrating modes, in particular, limit the vibration of the effective vibration skin 12 in vibrating modes in the low frequency range which include the fundamental tone. That is, a load of air in the shell 2 acts on the effective vibration skin 12 so as to limit the vibration of the effective vibration skin 12. Accordingly, the vibration of the effective vibration skin 12 attenuates early, that is, the sustain is shortened, in some vibrating modes (the vibrating mode in the low frequency range in particular).

When the effective vibration skins 12 of the batter head 3G and the snare head 3H are vibrated by striking the batter head 3G of the first-embodiment drum 40, air flows into and out of the shell 2 only through the openings 15. Thus, the effective vibration skin 12 of the batter head 3G freely vibrates without limitations imposed by air and the snare head 3H on which the snare wire 41 is pressed. Accordingly, the vibration of the effective vibration skin 12 attenuates later in the case of the first-embodiment drum 40 than in the case of the common drum, that is, the sustain is elongated, in vibrating modes including the above-described some vibrating modes (the vibrating mode in the low frequency range in particular).

Figure 15:
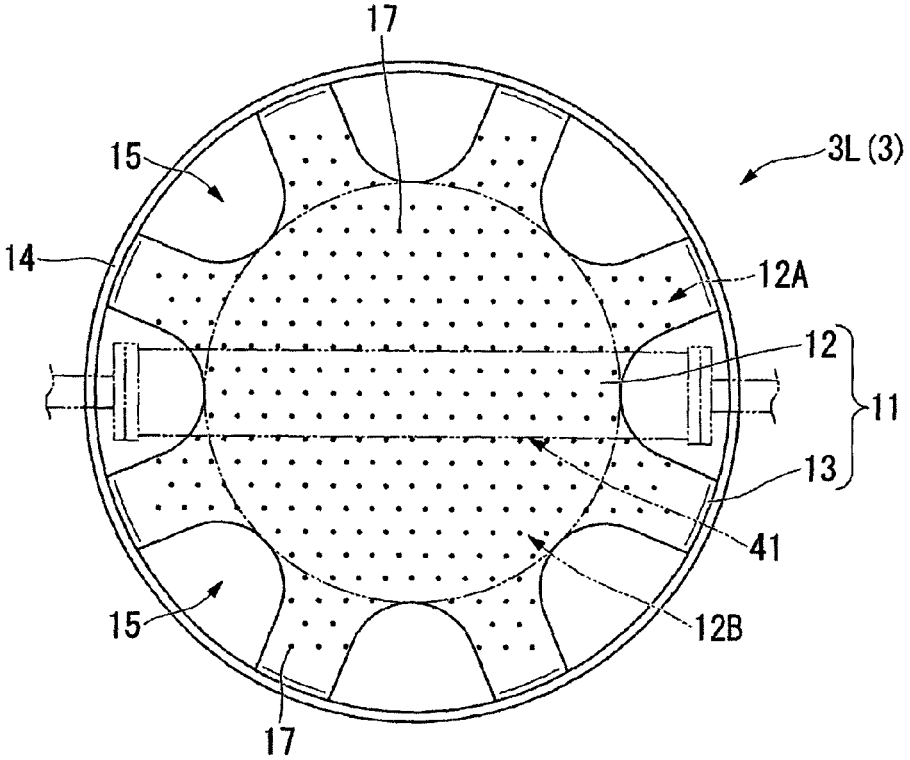
FIG. 15 is a bottom view of a snare head according to a modification of the second embodiment.

When the effective vibration skins 12 of the batter head 3K and the snare head 3L are vibrated by striking the batter head 3K of the second-embodiment drum 40A, air flows into and out of the shell 2 through not only the openings 15 but also the small holes 17. When the air passes through the small holes 17, a loss of energy is caused due to the principle of an orifice. This loss of energy reduces vibration of the effective vibration skin 12 in some vibrating modes (vibrating modes in the low frequency range in particular). As a result, as in the case of the common drum, the vibration of the effective vibration skin 12 attenuates early, that is, the sustain is shortened. This configuration can effectively reduce the sound volume produced by the second-embodiment drum 40A while keeping sounds and tone color produced by the common drum In the second embodiment, as illustrated in FIG. 15, the small holes 17 may be formed also in the effective vibration skin 12 of the snare head 3L, for example. In the construction in which the small holes 17 are formed in both of the batter head 3K and the snare head 3L, it is possible to further shorten the sustain of the fundamental tone (the produced sound) produced by the snare drum 40A. The small holes 17 may be formed only in the snare head 3L, for example. Since the small holes 17 are not formed in the batter head 3K in this construction, it is possible to improve durability of the batter head 3K to be struck with, e.g., sticks. The sustain of the fundamental tone (the produced sound) is slightly longer in this construction than in the second embodiment but shorter than in the case of the first-embodiment drum 40.

Figure 16:
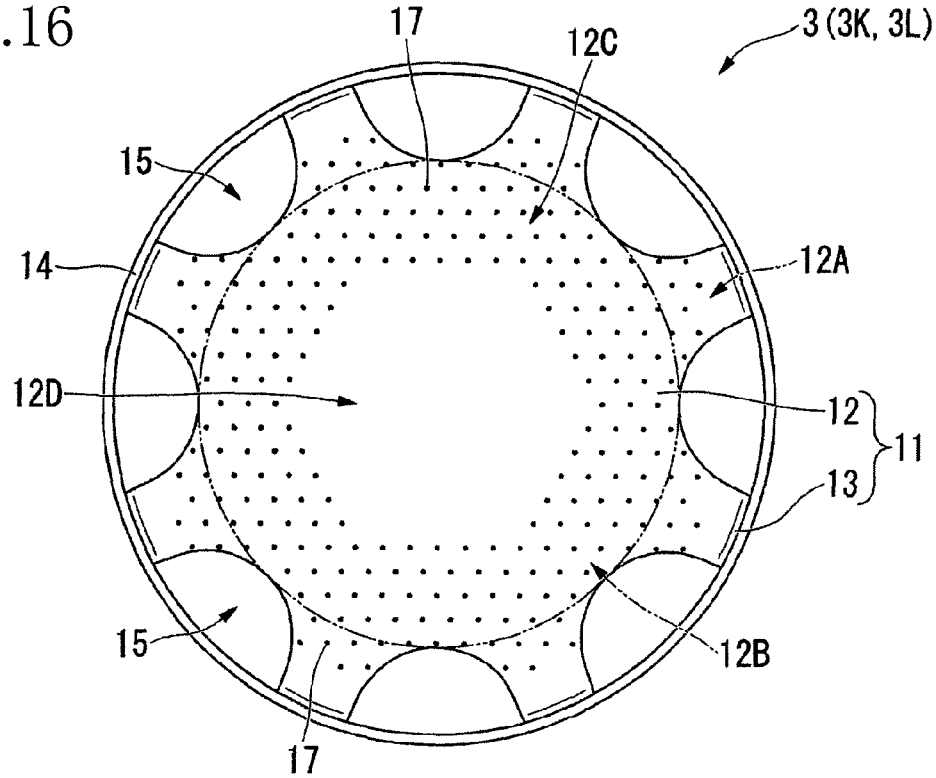
FIG. 16 is a plan view of a drum head according to a modification of the second embodiment.

FIG. 16 illustrates a modification of the second embodiment. In this modification, as illustrated in FIG. 16, the small holes 17 are formed only in a second outer region 12C of the effective vibration skin 12. That is, the small holes 17 are not formed in a second central region 12D of the effective vibration skin 12 inside the second outer region 12C. Like the outer region 12A, the second outer region 12C may be a region which is not to be struck or need not be struck by a player, for example. An inner edge of the second outer region 12C (i.e., a boundary between the second outer region 12C and the second central region 12D) may be located at the same position as an inner edge of the outer region 12A and as illustrated in FIG. 16 may be located inside the inner edge of the outer region 12A, for example. The second outer region 12C is preferably provided outside a distance of 55% of the radius of the effective vibration skin 12 in the radial direction, for example. In the case where the inner edge of the second outer region 12C is provided inside the inner edge of the outer region 12A, the area for the small holes 17 can be easily ensured. In the case where the small holes 17 are formed only in the second outer region 12C, the sustain of the overtones can be effectively made shorter than the sustain of the fundamental tone. In the case where this construction is applied to the batter head 3K, it is possible to improve durability of the batter head 3K to be struck with, e.g., sticks.

Figure 17:
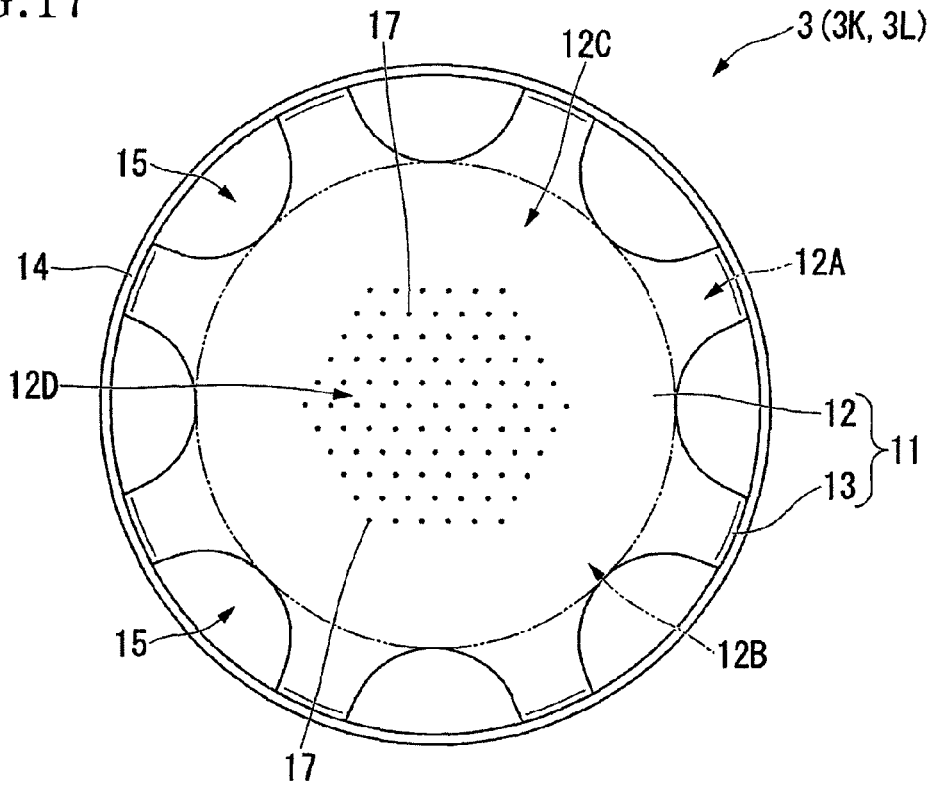
FIG. 17 is a plan view of a drum head according to a modification of the second embodiment.

FIG. 17 illustrates a modification of the second embodiment. In this modification, as illustrated in FIG. 17, the small holes 17 are formed only in a second central region 12D of the effective vibration skin 12. That is, the small holes 17 are not formed in the second outer region 12C. With this construction, the sustain of the fundamental tone can be effectively made shorter than the sustain of the overtones.

While the openings 15 are formed in both of the batter head 3K and the snare head 3L in the second embodiment and the modifications thereof, the openings 15 at least needs to be formed in the batter head 3K. The small holes 17 are additionally formed in at least one of the batter head 3K and the snare head 3L. Also, even in the case where the small holes 17 are formed in the snare head 3L not having the openings 15, the small holes 17 may be formed in the entire effective vibration skin 12, only the second outer region 12C, or only the second central region 12D. These constructions can achieve the same effects as achieved in the second embodiment.

The constructions in the second embodiment and the modifications thereof may be applied to the bass drums illustrated in FIGS. 11A-11C. That is, the bass drum may be constructed such that the openings 15 are formed in at least the batter head (as one example of the first drum head), and the small holes 17 are formed in at least one of the batter head and the front head (as one example of the second drum head). This construction can also achieve the same effects as achieved in the second embodiment. For bass drums, tight sounds are requested in most cases like the snare drums. Thus, it is effective to shorten the sustain by forming the small holes 17.

While the embodiments have been described above, it is to be understood that the disclosure is not limited to the details of the illustrated embodiments, but may be embodied with various changes and modifications, which may occur to those skilled in the art, without departing from the spirit and scope of the disclosure.

For example, the openings 15 formed in the drum head 3 at least needs to be arranged so as to be spaced apart from each other at least in the circumferential direction of the effective vibration skin 12. The openings 15 may be arranged with rotational symmetry or line symmetry with respect to the axis of the effective vibration skin 12 i.e., the axis of the shell 2, for example. Even in a drum head having the openings 15 arranged with rotational symmetry or line symmetry at irregular intervals, symmetry is achieved in some degree. Thus, such a drum head can produce tone color similar to that of the common drum head, with many vibrating modes being similar to those of the common drum head. However, in the drum head having the openings 15 arranged at irregular intervals, the symmetry is partly lost, resulting in change in some vibrating modes, when compared with the drum head 3 having the openings 15 arranged at regular intervals. Thus, the drum head 3 having the openings 15 arranged at regular intervals can produce tone color closer to that of the common drum head.

The present drum head can be applied to drums which produce sounds by being struck with striking means such as drum sticks, a foot pedal, mallets, and hands. The present drum head is applied to the drums including the cylindrical body having the two openings in the above-described embodiments but may be applied to drums including a body having one opening such as timpani, for example.

What is claimed is:

1. An apparatus, comprising:

a drum head comprising a skin, the skin comprising an inner skin and an outer skin formed integrally with an outer edge of the inner skin, wherein the inner skin comprises a plurality of openings arranged in a circumferential direction of the inner skin, and wherein an outline of each of the plurality of openings comprises an inner end portion in a radial direction of the skin in plan view, and the inner end portion protrudes and tapers inward in the radial direction.

2. The apparatus according to claim 1, wherein the plurality of openings are formed in an outer region of the inner skin.

3. The apparatus according to claim 1, wherein the plurality of openings are arranged in only one line along the circumferential direction.

4. The apparatus according to claim 1, wherein each of the plurality of openings is formed over a boundary between the inner skin and the outer skin.

5. The apparatus according to claim 1, wherein the inner skin is configured to vibrate when the drum head mounted on a body is struck.

6. The apparatus according to claim 1, wherein the outline of each of the plurality of openings comprises an outer end portion in the radial direction of the inner skin in plan view, and the outer end portion protrudes and tapers outward in the radial direction.

7. The apparatus according to claim 3, wherein the plurality of openings are formed only in the inner skin.

8. The apparatus according to claim 1, wherein a dimension of each of the plurality of openings in the radial direction of the inner skin is less than a dimension of each of the plurality of openings in the circumferential direction of the inner skin.

9. The apparatus according to claim 1, wherein the plurality of openings are arranged in the circumferential direction of the inner skin so as to be spaced at regular intervals or so as to have rotational symmetry.

10. The apparatus according to claim 1, wherein the inner skin comprises a plurality of small holes, each of the plurality of small holes being smaller in size than each of the plurality of openings.

11. The apparatus according to claim 1, further comprising:

a body, wherein the drum head is mounted in an opening of the body.

12. The apparatus according to claim 1, further comprising:

a body having a cylindrical shape; and another drum head, the drum head being mounted in a one-side opening of the body, and the another drum head being mounted in an other-side opening of the body, wherein at least one of the drum head and the another drum head comprises a plurality of small holes, each of the plurality of small holes being smaller in size than each of the plurality of openings.

* * * * *